US005338374A

United States Patent [19]

Marcus et al.

[11] Patent Number: 5,338,374

[45] Date of Patent: Aug. 16, 1994

[54] METHOD OF MAKING COPPER-TITANIUM NITRIDE ALLOY

[75] Inventors: Harris L. Marcus; Zwy Eliezer, both of Austin, Tex.; Morris E. Fine, Wilmette, Ill.

[73] Assignee: The United States of America as represented by the Secretary of the Navy, Washington, D.C.

[21] Appl. No.: 104,952

[22] Filed: Jul. 26, 1993

[51] Int. Cl.[5] ..... B22F 9/04; C23C 8/24

[52] U.S. Cl. ..... 148/237; 148/238; 75/351; 75/352; 75/357

[58] Field of Search ..... 75/351, 352, 357, 360; 148/207, 237, 238

[56] References Cited

U.S. PATENT DOCUMENTS 3,776,704 12/1973 Benjamin ..... 75/352
4,732,733 3/1988 Sakamoto et al. ..... 420/485
5,096,508 3/1992 Breedis et al. ..... 148/238
5,120,612 6/1992 Ashok ..... 420/492

OTHER PUBLICATIONS

J. S. Benjamin, et al. Metallurgical Transaction A; vol. 8A, P1301–P1305; Aug. 1977.

*Primary Examiner*—George Wyszomierski
*Attorney, Agent, or Firm*—William F. McCarthy; Thomas E. McDonald; James T. Busch

[57] ABSTRACT

A process for forming a copper alloy which is strengthened while maintaining good electrical and thermal conductivity by the addition of TiN or ZrN consists of external nitridation of a mechanically alloyed powder mixture followed by further mechanical alloying to break down the surface coating which forms during nitridation.

9 Claims, 4 Drawing Sheets

METHOD OF MAKING COPPER-TITANIUM NITRIDE ALLOY

BACKGROUND OF INVENTION

Copper when dispersion strengthened by oxides ($Al_2O_3$, $TiO_2$, $ZrO_2$ and BeO), borides ($TiB_2$) and carbides (ZrC, TaG and NbC) offers a unique combination of high strength and hardness with excellent electrical conductivity. Such alloys are used for the making of lead frames and spot welding electrodes. A good discussion of desirable lead frame characteristics is contained in U.S. Pat. No. 4,732,733 to Sakamoto, et al. The effectiveness of the dispersed particles in the matrix strengthening and the strength retention depends upon the particle size and interparticle spacing. The primary requirements to create a homogeneous dispersion of a second or hard phase are: (a) small particle size, (b) low interparticle spacing c) chemically stable second phase. The refinement of the second phase is very important according to Orowan's strengthening mechanism $\tau=\mu b/L$, where $\tau$ is the external stress, $\mu$ the modulus, b the Burgers vector and L the spacing of particles. Transition nitrides such as TiN and ZrN possess high electrical conductivity, high hardness and a high melting point. It is expected that a copper alloy dispersion hardened by TiN and ZrN would be extremely useful. However, little research has been done on the copper dispersion hardened by TiN and ZrN.

Previously, only TiN or ZrN surface films resulted when bulk copper alloys were exposed to a nitrogen environment at elevated temperatures. This is because of the insolubility of nitrogen in copper for both liquid and solid states. This method is described in U.S. Pat. No. 5,096,508 to Breedis, et al.

Therefore, in order to prepare a TiN dispersion hardened copper alloy a powder metallurgical method in combination with external nitridation was conceived. The idea of this mechanical alloying procedure was to break down the surface nitride of the alloy powder formed during nitridation in order to produce a homogeneous distribution of nitride in the matrix. A similar method has been used successfully to break down the surface $Al_2O_3$ on aluminium powder to fabricate aluminium alloy dispersion hardened by $Al_2O_3$. This is taught by the publication to J. S. Benjamin and M. J. Bomford in Metallurgical Transaction A, Vol. 8A, Aug. 1977,P1301-P1305. Compared with the conventional approach of directly mixing TiN and Cu powder, this procedure has the following advantages: (a) TiN is very uniformly distributed after nitridation process. The function of mechanical alloying is just to break down the thin TiN layer. (b) The surface layer thickness of TiN can be controlled by the size of the copper alloy powder. For the conventional alloying, many researchers have found it is not very efficient to crush down hard phases such as TaC and $ZrB_2$. Particle coarsening can usually be given by the equation $r^3-r_o^3=8V^2\gamma DC_it/9R$, where r and $r_o$ are the particle radius at time t and initially, V is the molar volume of the precipitate, $\gamma$ the particle/matrix surface energy, $C_i$ is the solubility of the particle and D is the diffusion constant of the rate limiting constituent. Thus to obtain a low coarsening rate and good thermal microstructural stability, the product of $\gamma$ $DC_i$needs to be small. In our case, because nitrogen is virtually insoluble in copper, the diffusion of nitrogen from small particles of nitrides to large particles through the Cu matrix is virtually impossible. That means the small nanophase nitride particles should be stable even at high temperatures approaching the melting temperature.

SUMMARY OF INVENTION

It is an object of the invention to make a TiN dispersion hardened copper alloy with high strength and electrical conductivity at high temperatures.

It is a further object of the invention to produce a Cu-TiN alloy by external nitridation of an alloyed Cu powder which is then further processed by mechanical alloying.

It is a still further object of the invention to produce a Cu-TiN alloy which exhibits a very high hardness value at low to intermediate temperatures of approximately 200° K. to 1100° K.

It is another object of the invention to produce a Cu-TiN alloy which has a high hardness value which is independent of temperatures below approximately 1100° K. and still maintains significant strength, after annealing, above that temperature.

DESCRIPTION OF PREFERRED EMBODIMENT

Figure 1:
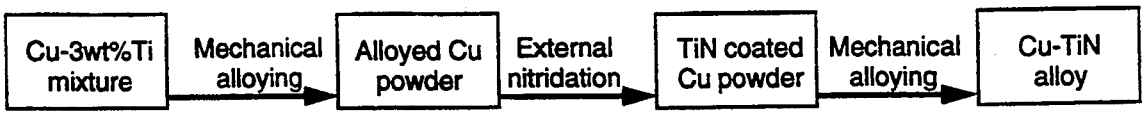
FIG. 1 is a block diagram of the steps used in the invention.

The starting materials used to carry out our invention were pure dendritic copper (−325 mesh, 99.79% in purity) and pure titanium (−100 mesh, 99.9% in purity). The procedure is shown in the block diagram of FIG. 1.

Mechanical alloying was performed with a Spex 8000 mixer/mill using hardened steel vial and grinding balls of 12.7 mm in diameter. The milling process was interrupted periodically and a small amount of the powder was taken out from the vial in a glove bag filled with high purity nitrogen. The ball milled powder was characterized by X-ray diffraction (XRD) using Cu K$\alpha$ radiation. Scanning electron microscopy (SEM) was used for morphological examination. Auger electron spectra were obtained for the sample mechanically alloyed for 16 hours using a 3 Key electron beam while the sample was sputtered with Argon(At) ions at $4*10^{-7}$ torr. Room temperature Vicker microhardness was measured for the consolidated and vacuum annealed samples using a load of 200g. The carbon extraction method was employed to observe the TEM images of the dispersed TiN particles.

Measurements indicated that as the microstructure of the powder during mechanical alloying evolved, the particles of titanium became finer as time continued.

Figure 2A:
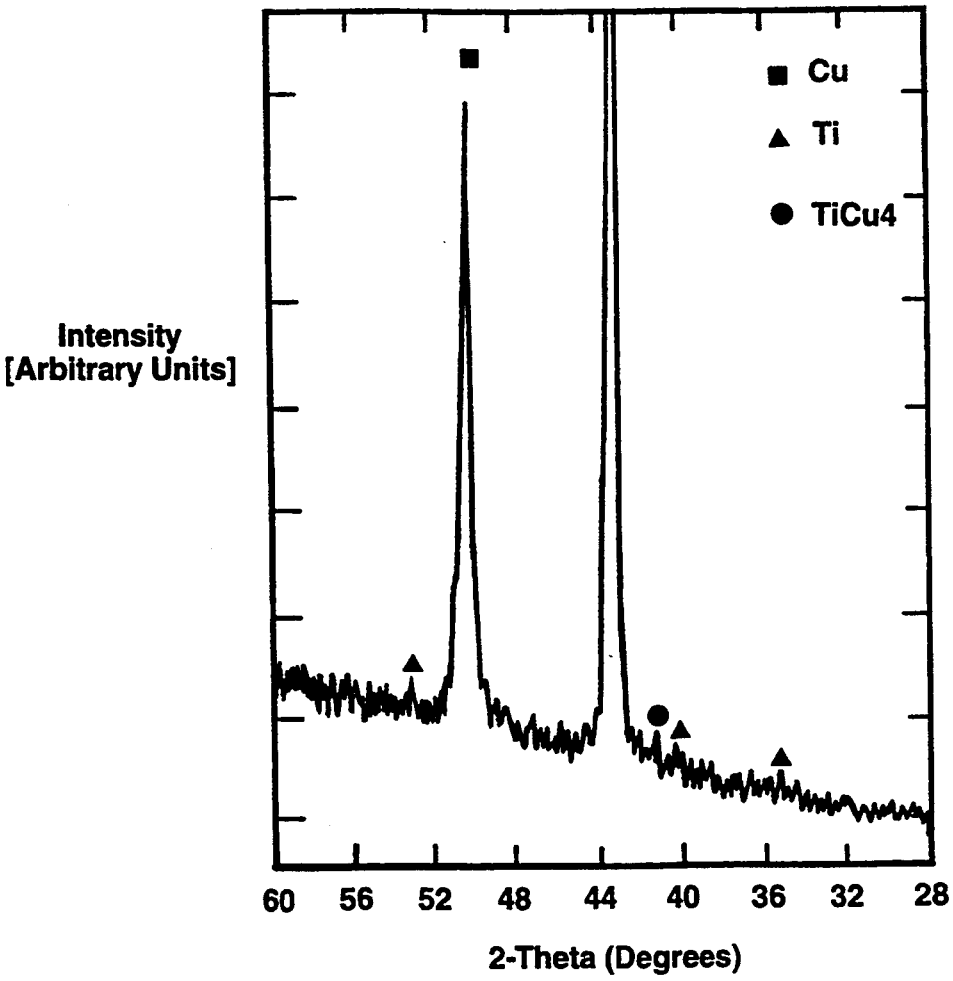
FIG. 2(*a*), (2(*b*) and 2(*c*) show X-Ray diffraction patterns of a CuTi mixture which is mechanically alloyed for increasing time periods, respectively.
Figure 2B:
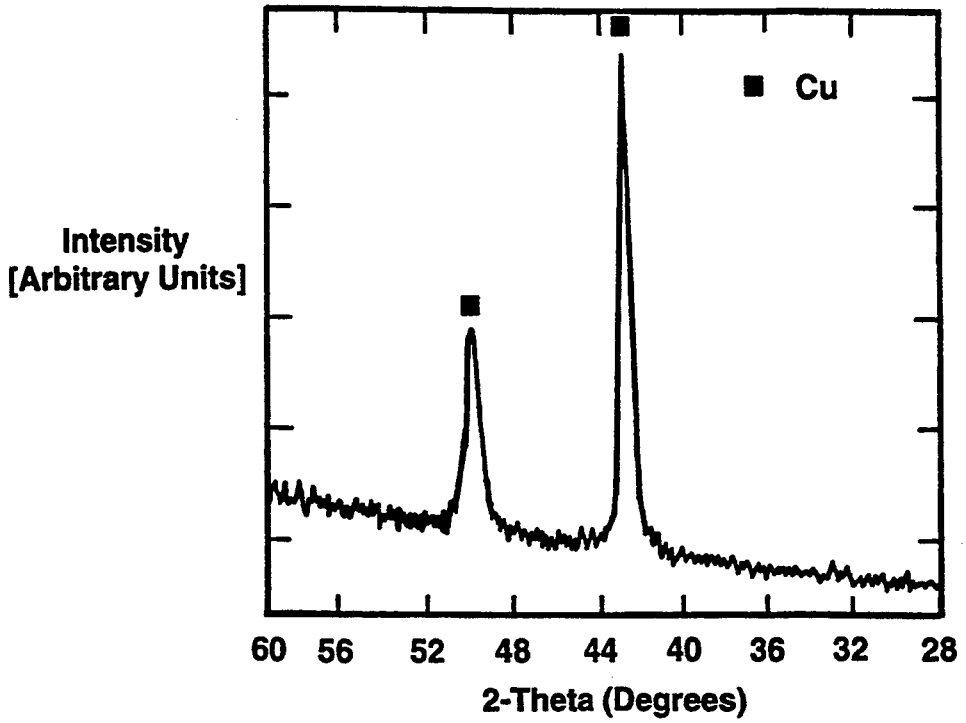
Figure 2C:
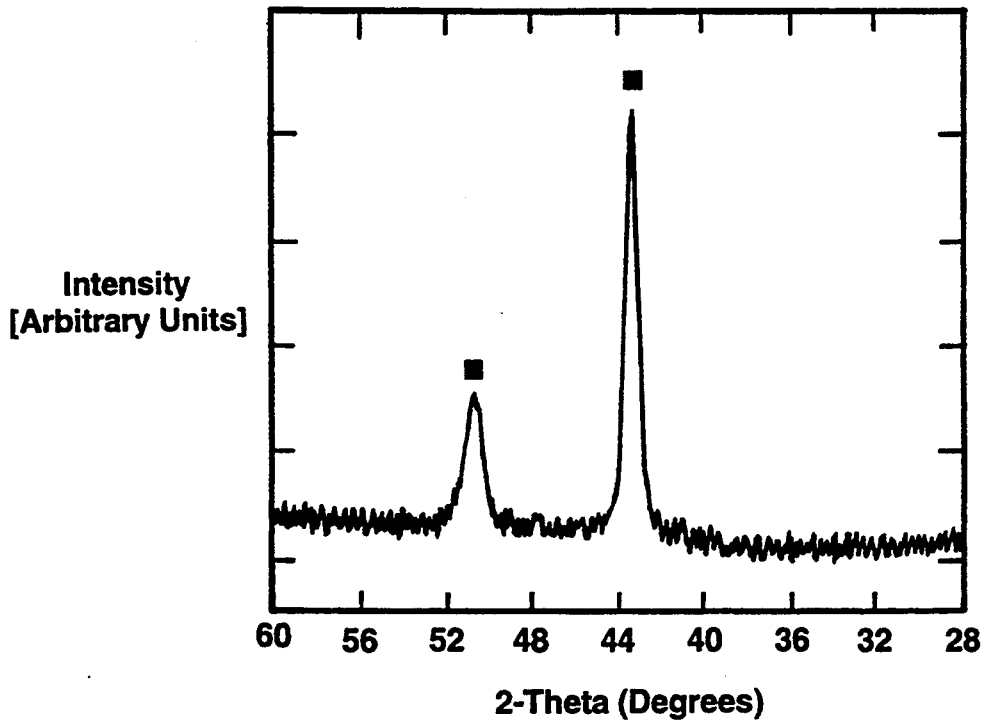
Figure 3A:
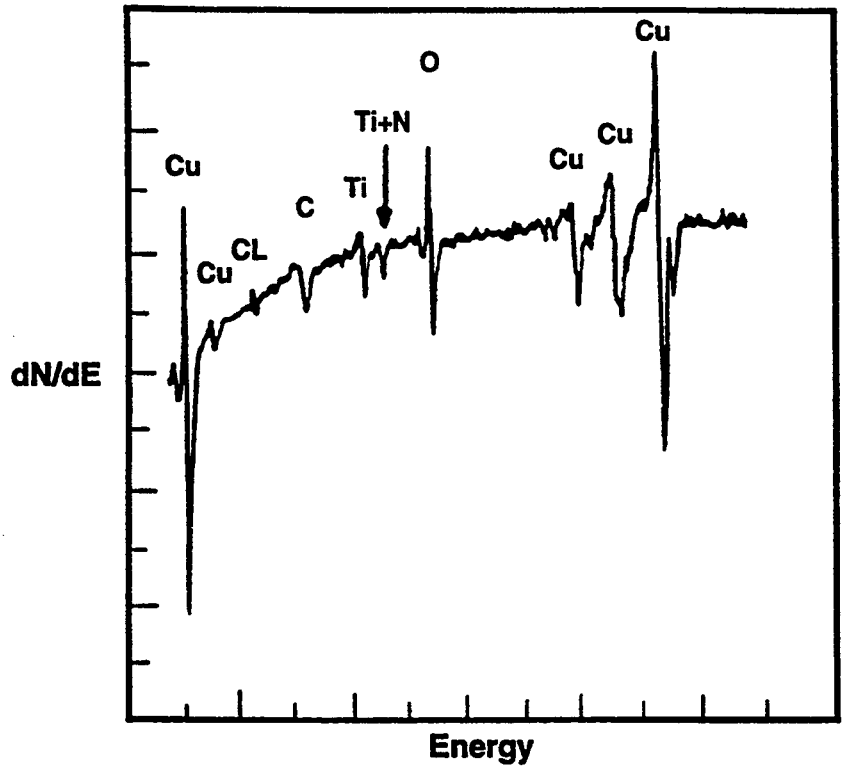
FIGS. 3(*a*) and 3(*b*) are Auger spectra for mechanically alloyed CuTi before and after Argon ion sputtering, respectively.
Figure 3B:
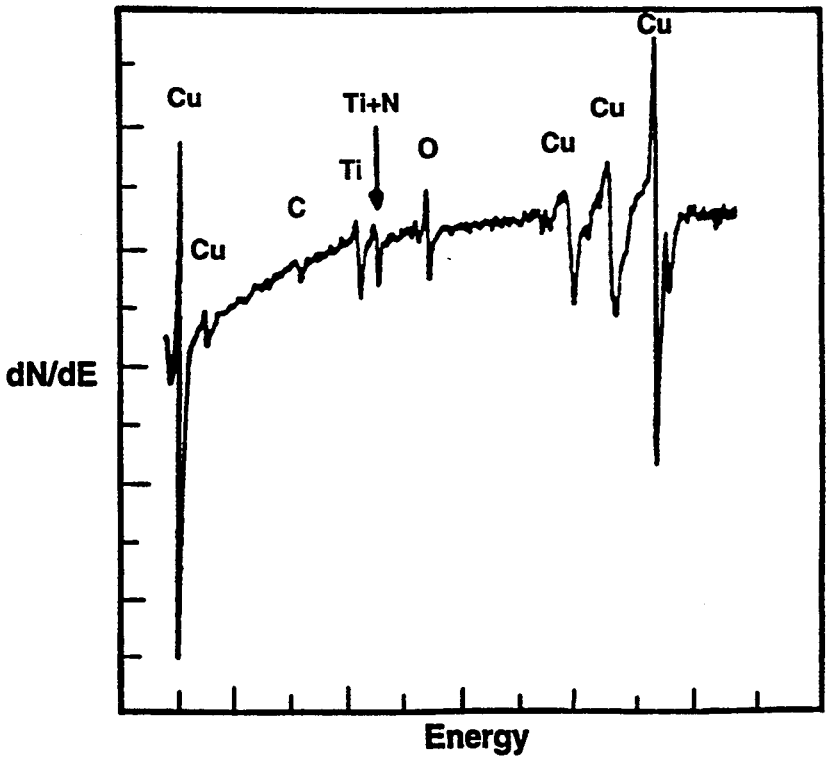

For the mixture alloyed for 1 hour, titanium particles of about 40 $\mu$m can be easily resolved by X-ray energy dispersive spectrum (EDS) mapping of titanium. The X-ray diffraction pattern depicted in FIG. 2A also showed the presence of a titanium peak. A small peak next to major copper peak may result from the intermetallic compound $TiCu_4$ formed during the milling. However, this peak was not detected in the XRD patterns for samples milled for 4.5 hours and 3.2 hours. As shown in FIG. 2B, a layered structure typical of the mechanical alloying process was developed for the powder milled for 4.5 hours and the titanium could still be resolved by EDS mapping of titanium, while the corresponding XRD pattern failed to detect the presence of titanium. Both SEM examination and the XRD pattern shown in FIG. 2C indicated that an almost complete solution had formed after mechanical alloying for 11.5 hours. EDS mapping of titanium showed the presence of titanium everywhere. As evidenced by the full width half maximum (FWHM) depiction in FIG. 2, the peaks of copper in the patterns became significantly broader during the milling due to the refinement of the crystal size and an increase in atomic level strain. Auger spectra for the samples mechanically alloyed for 16 hours are illustrated in FIGS. 3*a* and 3B which clearly reveal the presence of Ti, Cu, O and N after Ar ion sputtering for 0.6 ks. The peak to peak height of carbon is fairly small. Chlorine surface contamination disappeared after the first five minutes of Ar ion sputtering.

Figure 4:
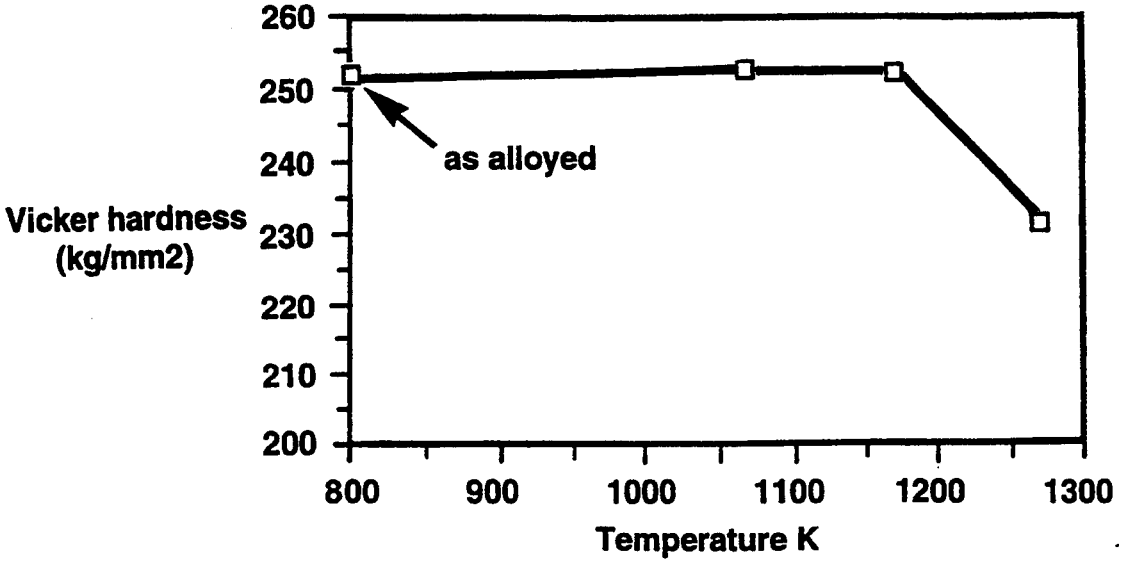
FIG. 4 is an X-Ray diffraction pattern for CuTi after nitridation for 24 hours.

Further, the characteristic peak shape of TiN was observed in this spectrum. It was noted that oxygen and nitrogen were absorbed during alloying process. This is attributed to the fresh and rough powder surfaces, which were very reactive, generated during the process. In fact nanometer size TiN, ZrN, $Cu_3N$, and $Si_3N_4$ have been synthesised by reactive mechanical alloying if nitrogen is introduced continuously. However, the x-ray diffraction measurements did not detect the existence of TiN or $TiO_2$. This indicates that the amount of TiN and $TiO_2$, if formed during the milling, was below the detection limit of XRD analysis. The powder mechanically alloyed for 16 hours was nitrided at 1073° K. for 24 hours and became golden coloured. The TiN layer formed on surfaces of powders was confirmed by X-ray diffraction analysis as shown in FIG. 4 and by SEM microphotographs. The nitrided powder was then spex-milled for 10 hours. Almost theoretical density occurred during the mechanical alloying process. The loose composite powders were changed into small agglomerates of various sizes up to 6 mm in diameter. Very few pores were observed under SEM examination. It was suggested that melting might occur during the mechanical alloying because of localized plastic shear.

Figure 5:
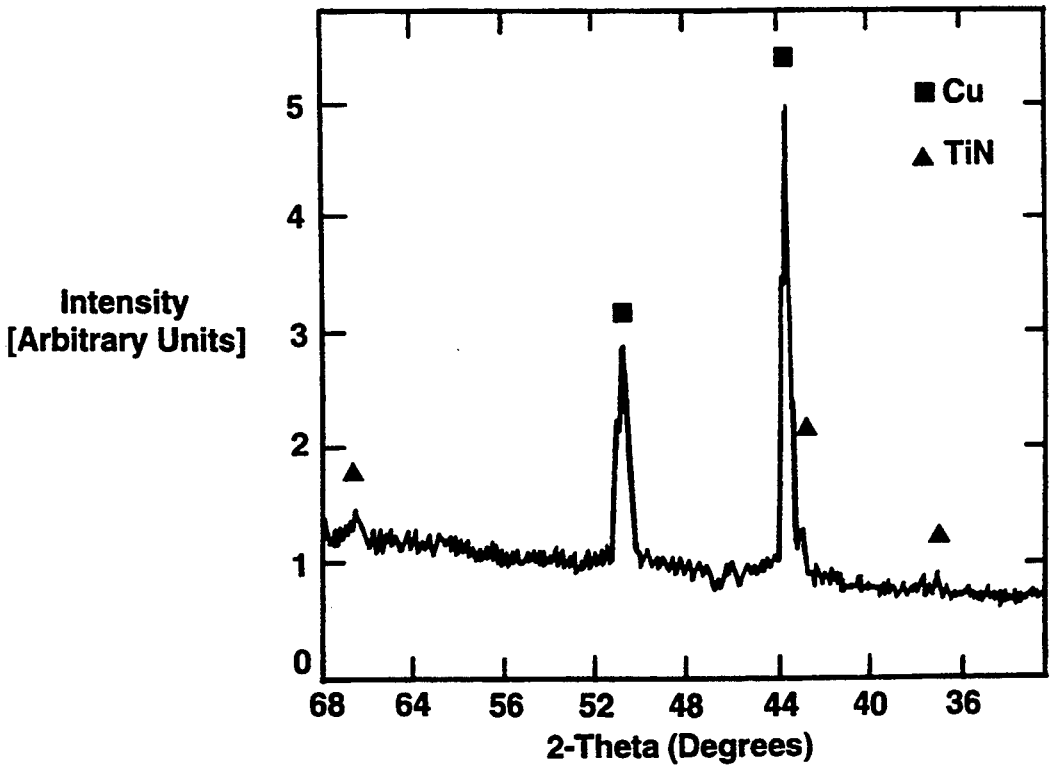
FIG. 5 is a graph showing that the alloy room temperature hardness is independent of annealing temperature below 1173° K.

Nanosize TiN particles were obtained by this external nitridation method in combination with machanical alloying. Occasional particles of the dispersion phase less than 1 μm were seen. Select area diffraction ring patterns indicate that larger particles consist of many small tiny TiN crystallines. These agglomerates were annealed at elevated temperature in a vacuum and showed very high room temperature hardness values which were independent of annealing temperature below 1173° K. as shown in FIG. 5. The hardness decreased slightly to 230 $Kg/mm^2$ for the sample annealed at 1273° K. for 1.5 hours. The grain growth of copper may be responsible for this hardness degradation because the transmission electron microscopy (TEM) image for the sample annealed at 1273° K. shows no difference in the size of TiN particles as compared with the as mechanically alloyed one. The SEM observation revealed the evidence of the thermally activated grain growth.

The microstructure of the samples heat-treated at 1073 for 1.5 hours and at 1173° K. for 2 hours are the same as that of the mechanically alloyed one. The grain size of copper must be in submicron range because high magnification SEM observation was not able to resolve it.

While the invention has been described in its best mode it should be understood that changes and modifications can be carried out without departing from the scope of the invention. In particular, the process while described in detail for a titanium-copper nitride alloy could also be used to make a zirconium-copper nitride alloy.

We claim:

1. A process for making a copper-titanium nitride alloy comprising the steps of:

a. mechanically alloying a copper and titanium mixture to form a fine CuTi alloy powder mixture, b. externally nitriding said alloy powder mixture to form a TiN coating on said alloy powder mixture, and c. mechanically alloying said coated alloy powder mixture to break down the TiN surface layer thereby obtaining a very fine uniform distribution of TiN in a Cu-Ti alloy,

2. The process of claim 1 in which said mixture is Cu - 3 wt % Ti and is mechanically alloyed in step (a) for approximately 12 hours.

3. The process of claim 1 in which said alloy powder mixture is nitrided at a temperature of approximately 1100° K. for approximately 24 hours to form said coated alloy powder mixture.

4. The process of claim 3 in which said TiN coated alloy powder mixture is mechanically alloyed in step (c) for approximately 10 hours,

5. A process for making a copper-titanium nitride alloy comprising the steps of:

a. mechanically alloying a copper and titanium mixture for approximately 12 hours to form a fine CuTi alloy powder mixture, b. externally nitriding said powder mixture at a temperture of approximately 1100° K. for approximately 24 hours to form a TiN coating on said alloy powder mixture, and c. mechanically alloying said coated alloy powder mixture at approximately 1100° K. for approximately 10 hours to break down the TiN coating thereby obtaining a very fine uniform distribution of TiN in a Cu-Ti alloy.

6. A process for making a copper alloy which is dispersion hardened by zirconium nitride comprising the steps of:

a. mechanically alloying a copper and zirconium mixture to form a fine CuZr alloy powder mixture, b. exposing said powder mixture in a nitrogen environment at high temperature to form a ZrN surface coating on said alloy powder mixture, and c. mechanically alloying said coated alloy powder mixture to break down the ZrN surface coating thereby obtaining a very fine uniform distribution of ZrN in a copper alloy.

7. The process of claim 6 in which said alloy powder mixture is formed by mechanically alloying said copper and zirconium mixture in step (a) for approximately 12 hours.

8. The process of claim 7 in which said alloy powder mixture is exposed to nitrogen at a temperature of approximately 1100° K. for approximately 24 hours so as to form a coating thereon.

9. The process of claim 8 in which the coated alloy powder mixture is mechanically alloyed in step (c) for approximately 10 hours.

* * * * *